United States Patent [19]

Pryor et al.

[11] 4,415,377

[45] Nov. 15, 1983

[54] DUPLEX ROLLING PROCESS AND APPARATUS

[75] Inventors: Michael J. Pryor, Woodbridge; William L. Brenneman, Cheshire, both of Conn.

[73] Assignee: Olin Corporation, New Haven, Conn.

[21] Appl. No.: 392,908

[22] Filed: Jun. 28, 1982

[51] Int. Cl.[3] ..... C21D 7/14

[52] U.S. Cl. ..... 148/12 R; 148/12 E; 148/12.4; 72/205; 72/366

[58] Field of Search ..... 148/12 R, 12 E, 12.4; 266/102, 115, 119, 134, 259; 72/205, 366

[56] References Cited

U.S. PATENT DOCUMENTS

| | | | |
|---|---|---|---|
| Re. 28,964 | 9/1976 | Nunes et al. | 148/12 E |
| 2,795,519 | 6/1957 | Angel et al. | 148/12 E |
| 3,216,868 | 11/1965 | Nachtman | 148/12 E |
| 3,332,292 | 7/1967 | Roberts | 72/8 |
| 4,244,203 | 1/1981 | Pryor et al. | 72/205 |

OTHER PUBLICATIONS

Journal of Materials Science, vol. 16, (1981), pp. 523–530 and 844–849, published by Chapman and Hall Ltd.

Materials Science and Engineering, vol. 30, (1977), pp. 93–98.

Journal of the Iron and Steel Institute, Oct. 1960, pp. 142–149.

Res Mechanica Letters, vol. 1, (1981), pp. 207–211.

Scripta Metallurgica, vol. 10, (1976), pp. 459–462.

Handbook of Stainless Steels, pp. 4–23–4–35, published by McGraw-Hill Book Company, 1977.

*Primary Examiner*—W. Stallard

*Attorney, Agent, or Firm*—Paul Weinstein; Howard M. Cohn; Barry L. Kelmachter

[57] ABSTRACT

A duplex rolling process and apparatus for working a metal or alloy subject to the formation of strain induced martensite. The metal or alloy is first worked at an elevated temperature wherein the formation of strain induced martensite is substantially suppressed or eliminated. The metal or alloy is then worked at a lower temperature wherein the formation of strain induced martensite is promoted whereby working is carried out more efficiently.

14 Claims, 6 Drawing Figures

DUPLEX ROLLING PROCESS AND APPARATUS

This invention relates to a process and apparatus for manufacturing cold rolled metals and alloys and the product produced thereby. The process and apparatus of the invention is particularly adapted to stainless steels characterized as a metastable austenitic stainless steels, for example, type 301 stainless steel. Such metastable austenitic stainless steels are known to transform to martensite by cooling below the martensite start temperature $M_s$. In view of their metastable nature it is also possible to obtain deformation induced transformation to martensite at temperatures above the $M_s$. Such strain induced martensitic transformations occur below the $M_d$ temperature which is the temperature above which no martensite forms when the alloy is deformed plastically.

In the case of type 301 stainless steels they achieve their high strength through a combination of strain hardening and strain induced martensitic transformation. In the processing of those materials commercially, however, the rolling speed is substantially limited in order to reduce the heating effects of rolling. The temperature rise in the material during rolling can be sufficient to exceed the $M_d$ temperature or at least substantially suppress the rate of martensitic transformation. To overcome this problem the prior art has limited the percent reduction taken in a given pass through the mill as well as the speed at which the strip is rolled. In practice, the rolling speed for manufacturing such metastable alloys is substantially reduced as compared to the commercial rolling speeds for other similar alloys which are not metastable in character.

In some prior art approaches such as the use of a Sendzimir rolling mill or cluster rolling mill it is difficult to prevent the strip from effectively heating up because such mills normally employ mineral oils which are not highly effective heat transfer mediums and because of the relatively small rolls which are difficult to cool in operation. The production penalty of reducing the strip speed during rolling and reducing the percent gage reduction per pass in order to minimize temperature rise during rolling can be quite costly.

The process and apparatus of the present invention is particularly adapted for use with a cooperative rolling mill of the type described in U.S. Pat. No. 4,244,203 to Pryor et al. Further improvements in the cooperative rolling mills are described in U.S. patent application Ser. No. 167,084, filed July 9, 1980, U.S. patent application Ser. No. 260,491, filed May 4, 1981, U.S. patent application Ser. No. 301,331, filed Sept. 11, 1981 and U.S. patent application Ser. No. 308,622, filed Oct. 5, 1981. The cooperative rolling process permits the establishment of significantly higher reductions per pass and significantly higher total reductions between interanneals. Because of the arrangement of the cooperative rolling mill which employs roll diameters generally larger than a comparable Sendzimir mill and which enables practical cooling of the strip and the rolls it should be possible to limit many of the deficiencies of the prior art processes and apparatuses. Further, the cooperative rolling mill can employ preferred cooling mediums such as soluble oils as opposed to mineral oils. Further, cooperative rolling may reduce frictional effects during rolling which tend to heat up the strip.

A number of articles have been published relating to metastable alloys of the type described above and the formation of strain induced martensite. For example, *Journal of Materials Science*, Vol. 16 (1981), pages 523–530, published by Chapman and Hall Ltd., *Materials Science and Engineering*, Vol. 30 (1977), pages 93–98, *Journal of the Iron and Steel Institute*, October, 1960, pages 142–149, *Res Mechanica Letters*, Vol. 1 (1981), pages 207–211, *Scripta Metallurgica*, Vol. 10, 1976, pages 459–462, *Journal of Materials Science*, Vol. 16 (1981), pages 844–849, published by Chapman and Hall Ltd., and *Handbook of Stainless Steels*, pages 4-23-4-35, published by McGraw-Hill Book Company, 1977.

In accordance with the present invention a rolling mill preferably of the cooperative rolling type is provided which is adapted to selectively process the metal strip at two separate and distinct processing temperatures. Initially, the strip is processed at an elevated temperature close to or exceeding the $M_d$ temperature of the alloy. The result of this portion of the process is to suppress the formation of strain induced martensite. Thereafter, the mill is automatically switched to operate at a temperature substantially below the first temperature of operation preferably at about room temperature. The purpose of this portion of the process is to provide for simultaneous work hardening and strain induced martensite transformation.

It has surprisingly been found that the work hardening rate for this type of alloy in the first stage of processing at the elevated temperature is considerably lower than the work hardening rate of the alloy if it had been worked at about room temperature. During the second stage of the process it has surprisingly been found that the work hardening rate of the alloy is substantially greater than the corresponding work hardening rate of an alloy worked solely at room temperature.

Accordingly, it is possible utilizing the rolling mill and process of this invention, adapted for operation at two distinct and separate rolling temperatures, to form a final strip more efficiently having the same properties as a conventionally formed alloy. For example, the alloy may be rolled at higher speeds in fewer passes and from a thicker starting gage without the necessity of an interanneal. The process and apparatus of this invention are adapted to a wide range of alloys which are subject to forming strain induced martensite including but not limited to metastable austenitic stainless steels, iron base alloys including nickel and/or manganese, etc.

It is believed that the process and apparatus of the present invention will result in a final product having a more finely divided martensitic phase as compared to a conventional processing. Further, the process and apparatus of this invention should provide an alloy having improved fatigue and toughness properties.

Accordingly, it is an advantage of this invention to provide an improved process and apparatus for rolling metals and alloys subject to the formation of strain induced martensite and to the product provided thereby.

It is a further advantage of this invention to provide a process and apparatus adapted to operate at two distinct temperatures in order to first suppress or eliminate strain induced martensite formation and to then substantially increase the formation of strain induced martensite, respectively.

These and other advantages will become more apparent from the following description and drawings.

In accordance with the present invention alloys subject to the formation of strain induced martensite during cold rolling are processed more efficiently. The processing is carried out in at least two stages. In the first stage the alloy is cold rolled a desired amount with the metal temperature during rolling of the alloy being maintained at or above a desired temperature at which the formation of strain induced martensite is substantially reduced or eliminated. The metal strip during this stage of processing is relatively soft as compared to strip processed in a conventional fashion due to the reduction in the amount of or the elimination of strain induced martensite formation. Its rate of work hardening is substantially reduced as compared to conventional processing thereby allowing greater reductions per pass and/or increased rolling speeds. Further, greater total reductions are possible because the separating force on the rolling mill necessary to accomplish the respective reductions per pass is reduced as compared to conventional processing.

During the first stage of rolling the alloy is rolled to a desired gage or thickness. Thereafter, the processing is carried out at a substantially lower metal strip temperature such that the formation of strain induced martensite during rolling is promoted. In the second stage of rolling the rate of work hardening is substantially increased as compared to the conventional process between comparable gages. Surprisingly, it has been found that it is possible to achieve the same properties as conventional processing while utilizing a higher rolling rate than the conventional process and larger reductions per pass.

Figure 1:
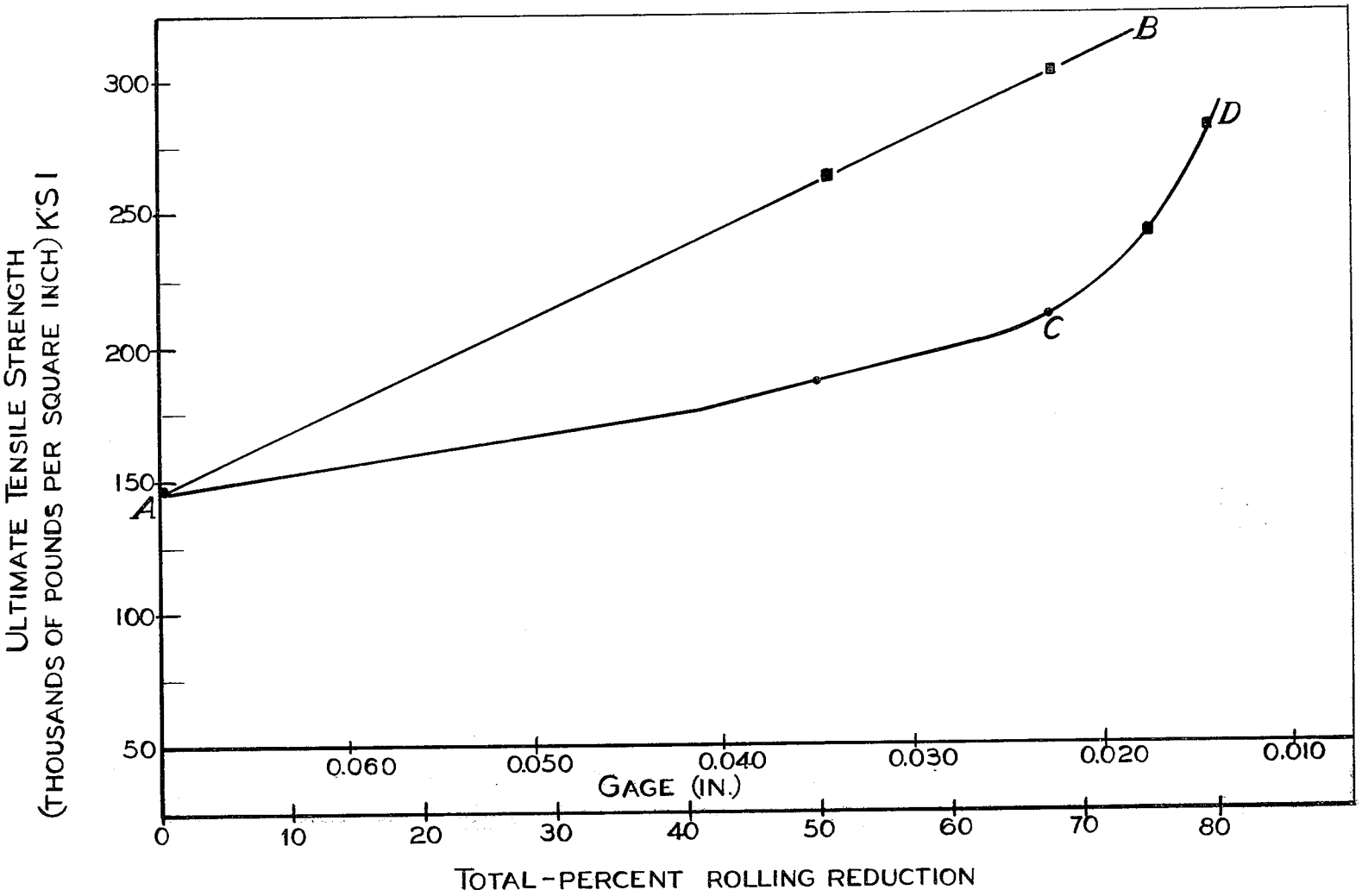
FIG. 1 is a graph showing the results of the two stage differential temperature process of the present invention as compared to a conventional process.

To illustrate the results of this process reference is had to FIG. 1. In FIG. 1, curve AB represents the results which are achieved by conventional processing. In the conventional process the metal is rolled in a series of passes and its tensile strength increases in a more or less linear fashion provided that the metal strip temperature during rolling is maintained low enough to allow for the formation of strain induced martensite. In contrast, the curve ACD in FIG. 1 shows the results of processing in accordance with this invention. The portion of the curve AC represents processing of metal strip in the first stage and the portion of the curve CD represents processing of the metal strip in the second stage. It is apparent that the rate of work hardening of the strip as determined by the slope of the curve in the first stage of processing is comparatively low as compared to the conventional process. It is also apparent that the rate of work hardening of the strip using the process of this invention in the second stage is considerably higher than the rate for comparable gages and reductions by conventional processing.

This unique combination of results from the process of this invention provides an approach wherein it is possible to roll to a substantial total reduction in thickness with a relatively low work hardening rate for the strip and to then markedly strengthen the strip by finish rolling in one or more passes at a lower temperature providing a substantially increased work hardening rate. It is, therefore, possible to achieve the same strength level at a desired gage more efficiently, namely at higher speed or with greater reductions between anneals or it is possible to achieve even higher results with those same efficiencies.

In the example illustrated in FIG. 1, two groups of A.I.S.I. type 301 stainless steel samples having the same composition and comprising metal strips 0.0698" thick by 1" wide by about 9" long were conventionally rolled on a four-high mill having 1½" thick work rolls. One group of strips were rolled at a room temperature of about 23° C. The other group of strips were given five passes at 95° C. and sixth and seventh passes at room temperature 23° C. Both groups of samples were rolled using a pass schedule of sequential 20% reductions per pass.

The data shown graphically in FIG. 1 clearly illustrate that the dual processing schedule of the present invention has several advantages. One is the reduced energy consumption due to about a one third lower separating force during the first stage of processing for any given mill. A second advantage is the increased production rate since the reduced work hardening rate provides a lower strip strength allowing larger total reductions to be taken. A third advantage is the increase in production rate since rolling speeds can be increased substantially during the warm rolling first stage of the pass schedule when heat extraction from the strip is not critical.

In general, during the first stage of processing the temperature of the metal strip during rolling should be maintained near or above the $M_d$ temperature. It is believed that the metal strip temperature should be at least within about 30% of the $M_d$ temperature in centigrade or higher and preferably within about 10% thereof or higher. In any event the metal strip temperature in the first stage of processing should be selected so as to substantially reduce or eliminate the formation of strain induced martensite during rolling. The suppression of the martensite formation during rolling in the first stage of the process is a significant aspect of the present invention. The maximum temperature employed during the first stage of processing may be set as desired. There is no advantage to heating the metal beyond a temperature necessary to suppress or eliminate the strain induced martensite formation.

It may be advantageous and it is a preferred aspect of the invention to utilize water soluble oils for lubrication and cooling of the rolling mill rolls and metal strip during processing. With this preferred approach, the upper limit for the first stage of processing should preferably be below the boiling point of water comprising 100° C. and most preferably below about 98° C. with a particularly preferred temperature comprising 95° C.

It is recognized, however, that for some alloys the temperature may need to be higher in order to sufficiently suppress the strain induced martensite formation. In this latter instance, it will be necessary to employ coolants and lubricants having substantially higher boiling points, for example, mineral oils or the like. In any event it is believed that the rolling process should be carried out at a temperature less than about 350° C.

In general, during the second stage of processing the temperature of the metal strip during rolling should be maintained well below the $M_d$ temperature. Preferably, the temperature of the metal strip during rolling in the second stage of processing is at least about 30° C. lower than the temperature of the metal strip in the first stage of processing. Most preferably, the temperature of the metal strip during rolling in the second stage of processing is at least 50° C. lower than the temperature in the first stage of processing. In any event, the temperature should be selected such that the formation of strain induced martensite is promoted. For type 301 stainless steel a room temperature of from about 15° to 60° C. and particularly about 20° to 50° C. has been found to be quite suitable for processing in the second stage.

Referring again to FIG. 1, the result of controlling the temperature of the metal strip during rolling in the manner above described is to substantially reduce the work hardening rate in the first stage of processing while substantially increasing the work hardening rate in the second stage of processing as compared to metal treated by conventional processing.

Having thus described the process in accordance with the present invention it has been found that the process can be uniquely and advantageously carried out through the use of a modified cooperative rolling mill. While the apparatus will be described in reference to a cooperative rolling mill it is possible to utilize other rolling mills if modified to the multi stage temperatures of operation approach of this invention.

The cooperative rolling system optimizes bi-axial forces to maximize rolling reduction through a process of non-symmetrical plastic flow. It is applicable to any desired metal or alloy which can be plastically deformed. It is particularly adapted for processing metal strip. Unusually high rolling reductions per pass and total rolling reductions between anneals with excellent surface finish and microstructure can be achieved through the use of a four high rolling mill modified in accordance with this invention. The cooperative rolling approach makes maximum utilization of the deformation ability of the metallic strip by optimization of roll compression and stretch elongation to derive maximum ductility.

The modification of the rolling mill involves primarily changing the drive mechanism so that the mill is back-up roll driven and the provision of some means for driving the back-up rolls at respectively different speeds one from the other.

Figure 2:
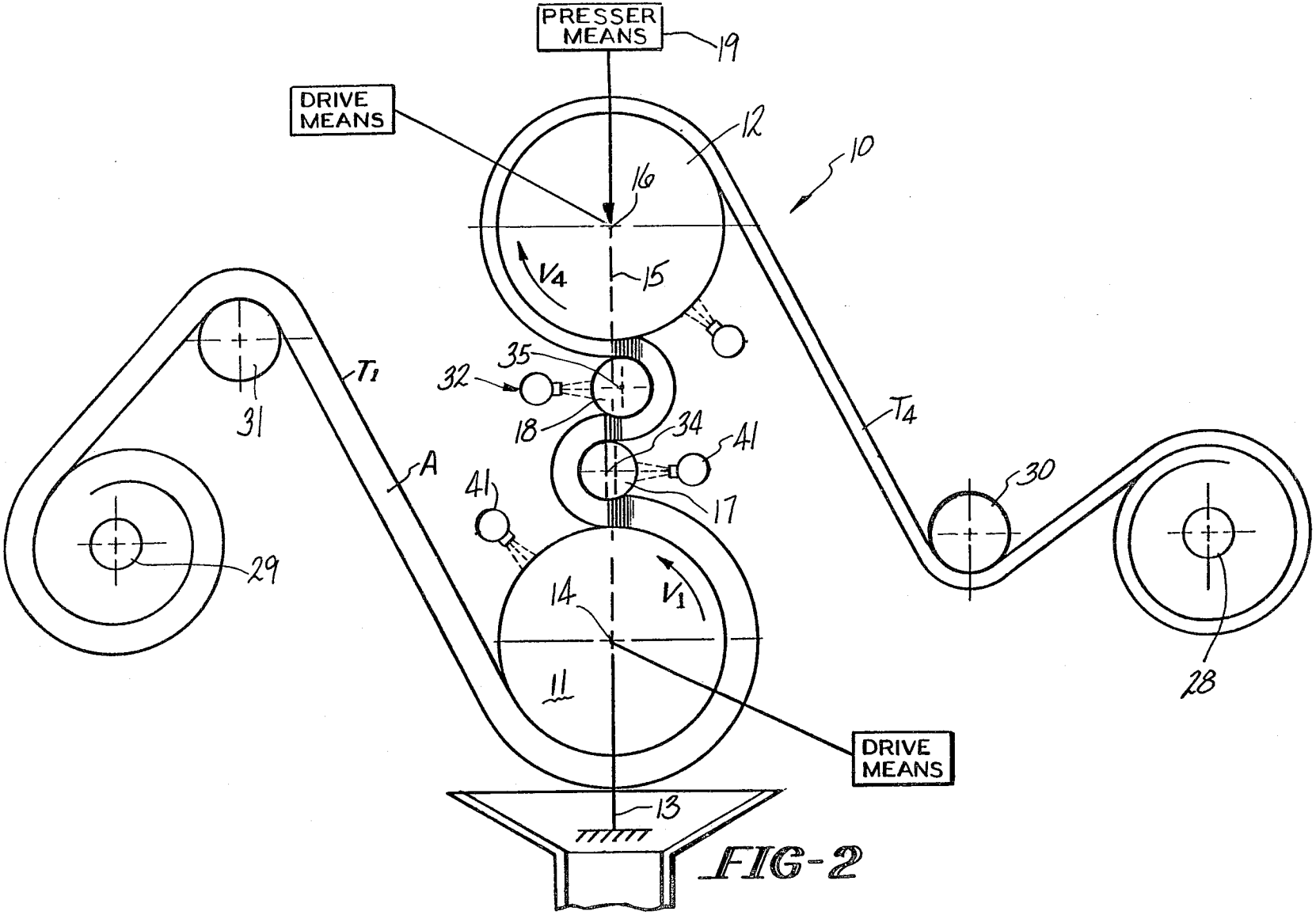
FIG. 2 is a schematic representation of a rolling mill in accordance with the present invention.
Figure 4:
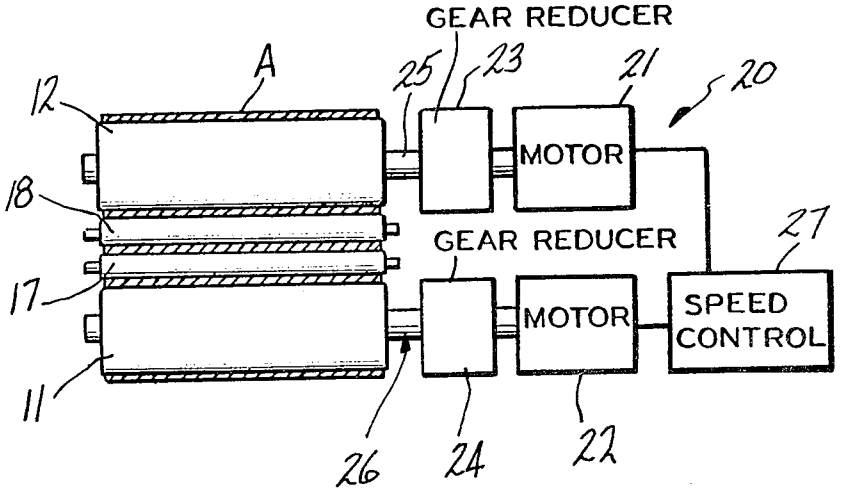
FIG. 4 is a schematic representation of a drive system for the rolling mill of FIGS. 2 and 3.
Figure 3:
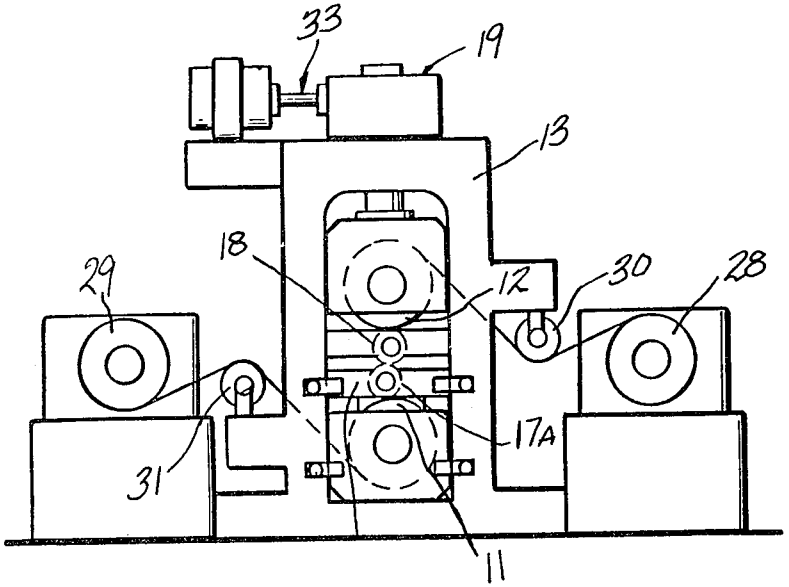
FIG. 3 is a schematic side view of the rolling mill of FIG. 1 showing further details of its arrangement.

Referring now to FIGS. 2–4, there is shown by way of example a cooperative rolling mill 10 in accordance with a preferred embodiment of the present invention. The cooperative rolling mill 10 comprises first 11 and second 12 back-up rolls of relatively large diameter. The lower back-up roll 11 is journaled for rotation in the machine frame 13 of the rolling mill 10 about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are two free wheeling work rolls 17 and 18 having a diameter substantially smaller than the diameter of the back-up rolls 11 and 12. The work rolls 17 and 18 are journaled for rotation and arranged to idle in the machine frame 13. They are adapted to float in a vertical direction along the plane 15. The specific support mechanisms for the respective rolls 11, 12, 17 and 18 of the mill 10 may have any desired structure in accordance with conventional practice as amply illustrated in the background of this application.

A motor driven screw down presser means 19 of conventional design is utilized to provide a desired compressive force between the back-up rolls 11 and 12 and their cooperating work rolls 17 and 18 and between the work rolls themselves. The arrangement discussed thus far is in most respects similar to the arrangement of a conventional four high rolling mill.

In accordance with cooperative rolling, a conventional mill is modified by changing the speed relationship between the lower back-up roll 11 and the upper back-up roll 12 such that the peripheral speed of the lower back-up roll $V_1$ is less than the peripheral speed $V_4$ of the upper back-up roll 12. This can be accomplished relatively easily by a two motor drive 20 as in FIG. 4 which will drive the upper back-up roll 12 at a higher speed relative to the lower back-up roll 11 in proportion to the desired reduction in thickness of the strip A passing through the mill. The back-up rolls 11 and 12 are driven by motors 21 and 22 which are connected to the rolls 11 and 12 through reduction gear boxes 23 and 24 and drive spindles 25 and 26. A speed control 27 is connected to the motors 21 and 22 in order to drive the rolls 11 and 12 at the desired speed ratio. The particular drive system 20 which has been described above does not form part of the present invention, and any desired drive system for driving the rolls 11 and 12 at the desired peripheral speed ratio could be employed. A two motor drive system similar to that shown in U.S. Pat. No. 3,332,292 to Roberts can be employed. The drive to the work rolls 17 and 18 is provided by the back-up rolls 11 and 12 acting through the encompassing strip A.

In a conventional four high rolling mill a single rolling bite would be taken in the strip A as it passed through the nip between the work rolls.

In accordance with cooperative rolling, the strip A is strung or threaded as shown in FIG. 2 whereby the incoming strip is wrapped around the slower moving back-up roll 11 and then forms an "S" shaped bridle around the work rolls 17 and 18 and finally exits by encompassing the fast moving back-up roll 12. In this manner three reductions as shown in FIG. 2 are taken in the strip A as it passes through the mill 10. The first reduction is between the slow moving lower back-up roll 11 and its cooperating lower work roll 17. The second reduction is between the lower and upper work rolls 17 and 18. The third reduction is between the upper work roll 18 and its cooperating fast moving upper back-up roll 12. Front and back tensions $T_1$ and $T_4$ are applied to the strip A in a conventional manner by any desired means such as the coiler/decoilers 28 and 29. Billy rolls 30 and 31 arranged as shown are used to redirect the strip A direction to provide the desired wrapping about the back-up rolls 11 and 12.

The strip A encompasses each of the work rolls 17 and 18 through about 180° of the circumference of the rolls. In the embodiment shown, the strip A encompasses each of the back-up rolls 11 and 12 to a greater extent, namely, about 270°. Since the strip A only encompasses the work rolls through about 180°, it is relatively easy to apply coolant and lubricant as shown in FIG. 2. The specific apparatus 32 for applying the coolant and lubricant may be of any desired conventional design as are known in the art. The large size of the back-up rolls 11 and 12 also allows for relatively easy application of coolant and lubricant as shown even with a high degree of wrap.

In operation of a cooperative rolling mill, the strip A is threaded through the mill 10 in the manner shown in FIG. 2, and suitable back and forward tensions $T_1$ and $T_4$ are applied to the leading and trailing portions of the strip A by means of the coiler/decoilers 28 and 29. The presser means 19 which may be of any conventional design and which may be hydraulically actuated (not shown) or screw actuated through a suitable motor drive 33 is operated to apply a desired and essential operating pressure or compressive force between the respective rolls 11, 12, 17 and 18. The tension $T_1$ and $T_4$ applied to the strip A preferably should be sufficient to prevent slippage between the rolls 11, 12, 17 and 18 and the strip A. The motors 21 and 22 are energized to advance the strip A through the mill 10 by imparting drive to the back-up rolls 11 and 12 which in turn drive the idling work rolls 17 and 18 through the strip A. The upper back-up roll 12 and the work rolls 17 and 18 are arranged for floating movement vertically along the plane 15. If desired, the roll axes 14, 16, 34 or 35 of each of the back-up rolls 11 and 12 and work rolls 17 and 18 could all lie in the single vertical plane 15 as shown. To preferably attain greater stability for the work rolls 17 and 18, the plane defined by the axes 34 and 35 of the work rolls 17 and 18 can be tilted slightly as shown with respect to the plane 15 defined by the axes 14 and 16 of the back-up rolls 11 and 12 so that the angle defined between the plane of the work rolls 17 and 18 and the plane 15 of the back-up rolls 11 and 12 is less than about 15° and preferably less than about 10°. The plane of the work rolls 17 and 18, if tilted at all, should preferably be tilted in a direction to further deflect the strip A, namely, clockwise as viewed in FIG. 2.

However, it may not be essential in accordance with this invention that the plane of the work rolls 17 and 18 be tilted with respect to the plane 15 of the back-up rolls 11 and 12 and such an expedient should only be employed in the event that it is necessary to provide stabilization of the work rolls 17 and 18. Alternatively, it is possible though not desirable to stabilize the work rolls 17 and 18 by the use of a stabilizing roller engaging the free surface of the work rolls 17 and 18 which in FIG. 2 is the surface to which the coolant and lubricant is directed. Such an approach would inhibit the application of coolant and lubricant.

In any event if it is desired to tilt the plane of the work rolls 17 and 18 relative to the plane 15 of the back-up rolls 11 and 12, the degree of tilt should be kept within the aforenoted ranges and should not be so great as to prevent the application of pressure by means 19 to the three roll bites.

The cooperative rolling apparatus 10 is particularly useful for the process of this invention because it is relatively easy to apply a combined coolant/lubricant to both the rolls and the strip. In accordance with the present invention it is preferred to control the strip temperature during rolling by controlling the coolant-/lubricant temperature. In the first stage of processing wherein it is desired to operate at a relatively elevated temperature the coolant application system applies a coolant at an elevated temperature as, for example, a temperature of 80° to 99° C. for a water based lubricant or coolant.

It is a feature of the present invention that apparatus 36 are provided for automatically changing the temperature of the coolant/lubricant at the completion of the first stage of processing to a temperature substantially lower during the second stage of processing. This may be accomplished in a number of ways.

Figure 5:
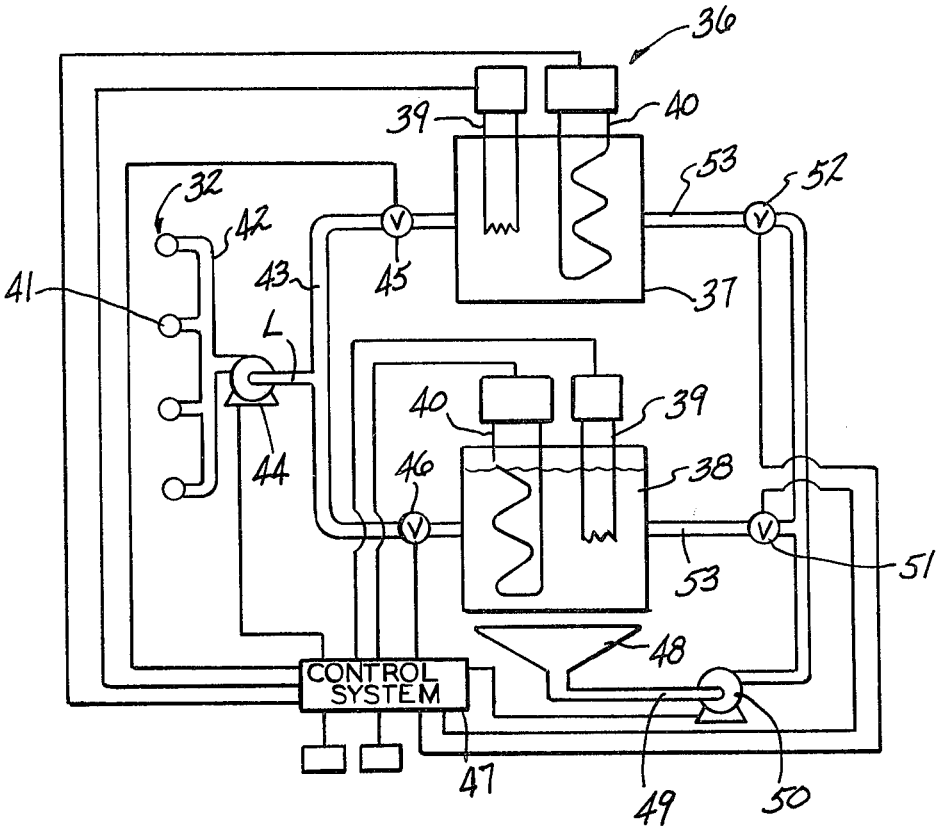
FIG. 5 is a schematic representation of the roll and strip coolant application system in accordance with a preferred embodiment of this invention.

Referring to FIG. 5, the coolant/lubricant application system 32 for the cooperative rolling mill of FIG. 2 is shown for a preferred embodiment of this invention. In this embodiment, two separate storage tanks 37 and 38 are provided for the coolant/lubricant. Each tank 37 or 38 includes a heating system 39 such as a resistance heater immersible in the tank 37 and a cooling system 40 such as a refrigerating type heat exchanger immersed in the coolant.

The coolant application nozzles 41 are selectively connected to the respective tanks 37 or 38 by a plenum 42 and conduits 43 as shown. A pump 44 is provided in a common leg L of the conduit 43 intermediate the spray nozzles 41 and storage tanks 37 and 38. Electrically operated valves 45 and 46 are provided at the output of each of the tanks 37 and 38. The valves 45 and 46 are actuated by a control system 47.

After the coolant/lubricant fluid is applied to the rolls 11, 12, 17 and 18 and strip A it runs down and is collected by a drain 48 which in turn is connected by a conduit 49 to each of the respective storage tanks 37 and 38 in order to return the coolant/lubricant to those tanks after use. A pump 50 is provided in the conduit 49 between the drain 48 and the respective storage tanks 37 and 38. Electrically operated valves 51 and 52 are also provided at each of the inlet portions 53 of the conduits to the respective storage tanks 37 and 38. These valves 51 and 52 are also actuated by the control system 47.

The respective heating 39 and cooling 40 systems are independently connected to the control system 47 as shown. The control system 47 may be of conventional design employing electromechanical elements or it can comprise a digital or computer operated system. The control system 47 is designed to automatically control the temperature changing system 36 in a manner to provide automatic switching of the coolant/lubricant temperature between the respective processing stages.

In operation, the control system 47 controls the apparatus of FIGS. 2 to 5, preferably, as follows. During the first stage of processing the coolant/lubricant in tank 37 is heated to the desired elevated temperature for suppressing the formation of strain induced martensite. The valves 45 and 52 are open and the valves 46 and 51 are closed. The coolant/lubricant is then pumped by pump 44 from the storage tank to the spray nozzles 41 which apply it to the respective roll and metal strip surfaces. The coolant/lubricant temperature controls the temperature of the strip during processing. If a cooperative rolling apparatus 10 is employed, frictional heating of the strip A may be minimized due to the nature of that rolling process. This enables control of the strip temperature by the coolant/lubricant application system 32 in the most efficient manner. After the coolant is applied to the strip and rolls, it flows downwardly in the mill 10 and is collected by the drain 48. It is then pumped via conduit 49 and pump 50 back to the storage tank 37. The temperature of the lubricant in the storage tank 37 is maintained substantially constant by the heating 39 and cooling 40 systems to compensate for any increase or decrease in the coolant temperature during rolling.

The control system 47 is programed or preset to sense or determine when to change the mill 10 from its first stage of operation to the second stage of operation. This can be accomplished by predetermining in the control system 47 the number of passes to be conducted in the first stage of processing and sensing in a conventional manner as by means of a counter the number of passes of the strip in the mill. When the desired number of passes is sensed, the control system 47 automatically conditions the coolant application system 32 and 36 to change the temperature of the coolant/lubricant applied to the mill 10. In the apparatus of FIG. 5, this conditioning step comprises closing the valves 45 and 52 and opening the valves 46 and 51 whereby the coolant in tank 38 now flows through the coolant application system 32 and is applied to the strip and rolls by the respective nozzles 41.

The temperature of the coolant/lubricant in the tank 38 is also maintained substantially constant at a temperature substantially below the coolant/lubricant in the first tank 37 by means of the heater 39 and cooling systems 40. Those systems 39 and 40 are again employed to compensate for any temperature change in the coolant or lubricant during the rolling operation. The rolling mill operates with the coolant application system 32 utilizing the coolant from tank 38 during the entire second stage of processing.

Following the completion of the metal processing the control system 47 would be reset automatically so that the next coil of metal would be rolled by the first stage of processing utilizing the coolant from tank 37. This could be accomplished by sensing removal of the metal strip coil being processed from the mill 10 in a conventional fashion.

The sensor (not shown) for sensing the number of passes can comprise a conventional photo optic type sensor. The sensor for sensing the end of the second stage of processing can comprise a simple switch or photodetector for sensing removal of the coil from the coiler 28 or 29.

Figure 6:
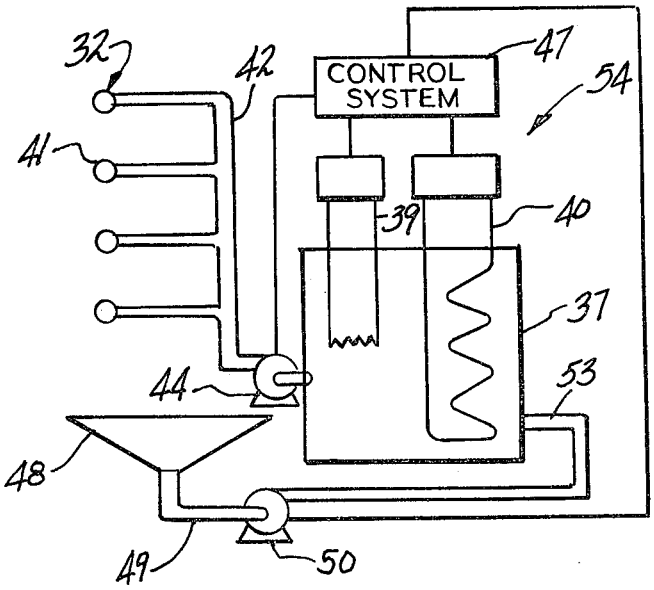
FIG. 6 is a schematic representation of a roll and strip coolant system in accordance with an alternative embodiment of this invention.

While the invention has been described in reference to a coolant temperature change system 36 employing dual coolant reservoirs 37 and 38 it could employ, though it is believed less preferable, a coolant application system utilizing a single reservoir or tank 37. Such a system 54 is shown in FIG. 6. In this system 54, the coolant/lubricant is applied to the mill 10 from a single tank 37 in the same manner as described previously and like elements have been similarly numbered. In order to change the coolant/lubricant temperature between processing stages the control system 47 upon sensing the end of the first processing stage in the same manner as in the previous embodiment inhibits further processing while the coolant/lubricant temperature is reduced by means of the refrigerating heat exchanger 40 to the desired temperature for second stage processing. Upon reaching the desired temperature in the coolant/lubricant tank 37 the second stage of processing is then carried out by actuating pumps 44 and 50. In this embodiment the application of coolant is controlled by controlling the pump on the output of the coolant/lubricant tank. However, if desired, electrically operated valves could be used to control the on and off periods of coolant flow.

A.I.S.I. type 301 stainless steel generally has a composition by weight percent comprising: 0.15% maximum carbon; 2.0% maximum manganese; 1.0% maximum silicon; 16.0 to 18.0% chromium; 6.0 to 8.0% nickel; and the balance iron. The steels used in the example of FIG. 1 had a nominal composition comprising in weight percent about 0.09% carbon; 0.96% manganese; 0.022% phosphorous; 0.007% sulfur; 0.22% silicon; 6.4% nickel; 16.49% chromium; 0.21% molybdenum; 0.12% copper and the balance iron.

While the invention has been described in reference to A.I.S.I. Type 301 stainless steel it is applicable to any metal or alloy subject to the formation of strain induced martensite including metastable austenitic stainless steels such as the aforenoted type 301 and iron base alloys including nickel and/or manganese, etc.

The U.S. patents and articles set forth in this application are intended to be incorporated by reference herein.

It is apparent that there has been provided in accordance with this invention a duplex rolling process and apparatus which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A process for working a metal or alloy subject to the formation of strain induced martensite comprising:

working said metal or alloy to reduce its thickness in a first stage of processing at a metal temperature at or above a first desired temperature at which the formation of said strain induced martensite is substantially suppressed or eliminated; and working said metal or alloy following said first stage of processing in a second stage of processing to further reduce its thickness, said second stage working being carried out at or below a second desired temperature which is substantially lower than said first temperature and is selected such that the formation of strain induced martensite during said second stage working is promoted;

whereby said working can be carried out more efficiently.

2. A process as in claim 1 wherein said first desired temperature comprises a temperature within about 30% of the $M_d$ temperature in centigrade of said metal or alloy.

3. A process as in claim 2 wherein said first desired temperature is within about 10% of said $M_d$ temperature of said metal or alloy.

4. A process as in claim 1 wherein said first desired temperature comprises less than about 100° C. such that it is possible to use water soluble oils for lubrication and cooling during said first stage of working.

5. A process as in claim 1 wherein said working in said first and second stages of processing comprises rolling said metal or alloy and further including the steps of controlling the temperature of working in said first stage of processing and in said second stage of processing, wherein said controlling step comprises applying a coolant and lubricant to said metal or alloy during said rolling and selectively controlling the temperature of said coolant and lubricant to provide said first and second desired temperatures of working.

6. A process as in claim 5 wherein said step of controlling said temperature of said coolant and lubricant comprises providing a first supply of said coolant and lubricant at a temperature to provide said first desired temperature during said first stage of working, providing a second supply of coolant and lubricant at a temperature to provide said second desired temperature during said second stage of working and selectively applying lubricant from said first supply or said second supply, respectively, during said first stage of working and said second stage of working, respectively.

7. A process as in claim 6 further including the steps of controlling the temperature of the coolant and lubricant in said first and second supplies thereof.

8. A process as in claim 5 comprising providing a supply of coolant and lubricant for application during said first and second stages of working, controlling the temperature of said coolant and lubricant at a first level during said first stage of processing, changing the temperature of said coolant and lubricant to a second level during said second stage of processing and inhibiting said second working operation during said step of changing said temperature level.

9. A process as in claim 1 wherein said metal or alloy comprises A.I.S.I. Type 301 stainless steel and wherein said first desired temperature comprises about 98° C. and wherein said second desired temperature comprises about 15° to 60° C.

10. An apparatus for working a metal or alloy subject to the formation of strain induced martensite comprising:

means for working said metal or alloy to reduce its thickness in a first stage of processing at a metal temperature at or above a first desired temperature at which the formation of said strain induced martensite is substantially suppressed or eliminated; and means for working said metal or alloy after said first stage of processing to further reduce its thickness in a second stage of processing by working said metal or alloy at or below a second desired temperature which is substantially lower than said first temperature and is selected such that the formation of strain induced martensite is promoted;

whereby said working can be carried out more efficiently.

11. An apparatus as in claim 10 wherein said means for working said metal or alloy comprises means for rolling said metal or alloy and further including means for controlling the temperature of working in said first stage of processing and in said second stage of processing, said means for controlling said temperature comprising means for applying a coolant and lubricant to said metal or alloy during said rolling and means for selectively controlling the temperature of said coolant and lubricant to provide said first and second desired temperatures of working.

12. An apparatus as in claim 11 wherein said means for controlling said temperature comprises first means for supplying coolant and lubricant at a temperature to provide said first desired temperature during said first stage of working; second means for supplying coolant and lubricant at a temperature to provide said second desired temperature during said second stage of working and means for selectively applying lubricant from said first or second supply means, respectively, during said first or second stages of working, respectively.

13. An apparatus as in claim 12 further including means for controlling the temperature of the coolant and lubricant in said first and second supplying means.

14. An apparatus as in claim 11 further including means for supplying said coolant and lubricant for application during said first and second stages of working; means for controlling the temperature of said coolant and lubricant in said supply means at a first level during said first stage of processing; means for changing the temperature of said coolant and lubricant to a second level while inhibiting said rolling means; means for controlling said temperature or said coolant and lubricant at said second level during said second stage of processing; and means for changing said coolant and lubricant back to said first level while inhibiting said rolling means.

* * * * *